US011814828B2

(12) United States Patent
Yang

(10) Patent No.: US 11,814,828 B2
(45) Date of Patent: Nov. 14, 2023

(54) SHOWER DEVICE

(71) Applicant: Tsai-Chen Yang, Taichung (TW)

(72) Inventor: Tsai-Chen Yang, Taichung (TW)

( * ) Notice: Subject to any disclaimer, the term of this patent is extended or adjusted under 35 U.S.C. 154(b) by 225 days.

(21) Appl. No.: 17/404,406

(22) Filed: Aug. 17, 2021

(65) Prior Publication Data

US 2023/0054998 A1 Feb. 23, 2023

(51) Int. Cl.
*E03C 1/04* (2006.01)
*B05B 15/65* (2018.01)
*E03C 1/02* (2006.01)

(52) U.S. Cl.
CPC ..... *E03C 1/0408* (2013.01); *B05B 15/65* (2018.02); *E03C 2001/026* (2013.01)

(58) Field of Classification Search
CPC . E03C 1/0408; E03C 2001/026; B05B 15/65; B05B 15/60
USPC ..... 239/443, 446, 447, 569, 581.1
See application file for complete search history.

(56) References Cited

U.S. PATENT DOCUMENTS

2014/0076445 A1* 3/2014 Zhou ..... F16L 27/047 137/874

* cited by examiner

*Primary Examiner* — Christopher S Kim
(74) *Attorney, Agent, or Firm* — Muncy, Geissler, Olds & Lowe, P.C.

(57) ABSTRACT

A shower device is provided, including: a pipe assembly, including an inlet pipe, an outer pipe and an inner pipe disposed in the outer pipe, the outer pipe including a first end portion in communication with the inlet pipe and a second end portion; a water separator, including a first port, a second port and a control valve, the first port including a first assembling portion connected with the second end portion and a second assembling portion, an inlet end portion of the inner pipe being connected with the second assembling portion, the second port including an outlet; and a shower flower, being connected with the outer pipe and in communication with the inner pipe; wherein the control valve is configured to conduct communication of the outer pipe and the inner pipe or to conduct communication of the outer pipe and the outlet.

6 Claims, 7 Drawing Sheets

SHOWER DEVICE

BACKGROUND OF THE INVENTION

Field of the Invention

The present invention relates to a shower device.

Description of the Prior Art

The conventional shower device generally includes a handle shower and an upper shower flower. A user can choose to use the upper shower flower to easily wash the shoulders and neck of the body, or can choose to use the handle shower which is flexibly movable to wash any parts of the body.

The control mechanism of the conventional shower device for switching to use the handle shower or the upper shower flower is commonly located lower for ergonomic operation of the user, wherein the water inlet corresponds to the height of the control mechanism and supplies water. However, if the position of the water inlet needs to be changed (for example, the water inlet should be higher than the control mechanism), the wall structure has to be destroyed so as to provide a space for mounting and at least partially burying the inlet pipe that supplies the water to the control mechanism, which badly affects the appearance of the wall structure.

The present invention is, therefore, arisen to obviate or at least mitigate the above-mentioned disadvantages.

SUMMARY OF THE INVENTION

The main object of the present invention is to provide a shower device which has a simple configuration and is ergonomic.

To achieve the above and other objects, a shower device is provided, including: a pipe assembly, including an inlet pipe, an outer pipe and an inner pipe, the inner pipe being disposed in the outer pipe, the inlet pipe being configured to be in communication with a water supply source, the outer pipe including a first end portion and a second end portion, the inlet pipe being connected and in communication with the first end portion of the outer pipe; a water separator, including a first port, a second port and a control valve, the first port including a first assembling portion and a second assembling portion, the second end portion of the outer pipe being connected with the first assembling portion, an inlet end portion of the inner pipe being connected with the second assembling portion, the second port including an outlet; and a shower flower, being connected with the outer pipe and in communication with the inner pipe; wherein the control valve is configured to conduct communication of the outer pipe and the inner pipe or to conduct communication of the outer pipe and the outlet.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
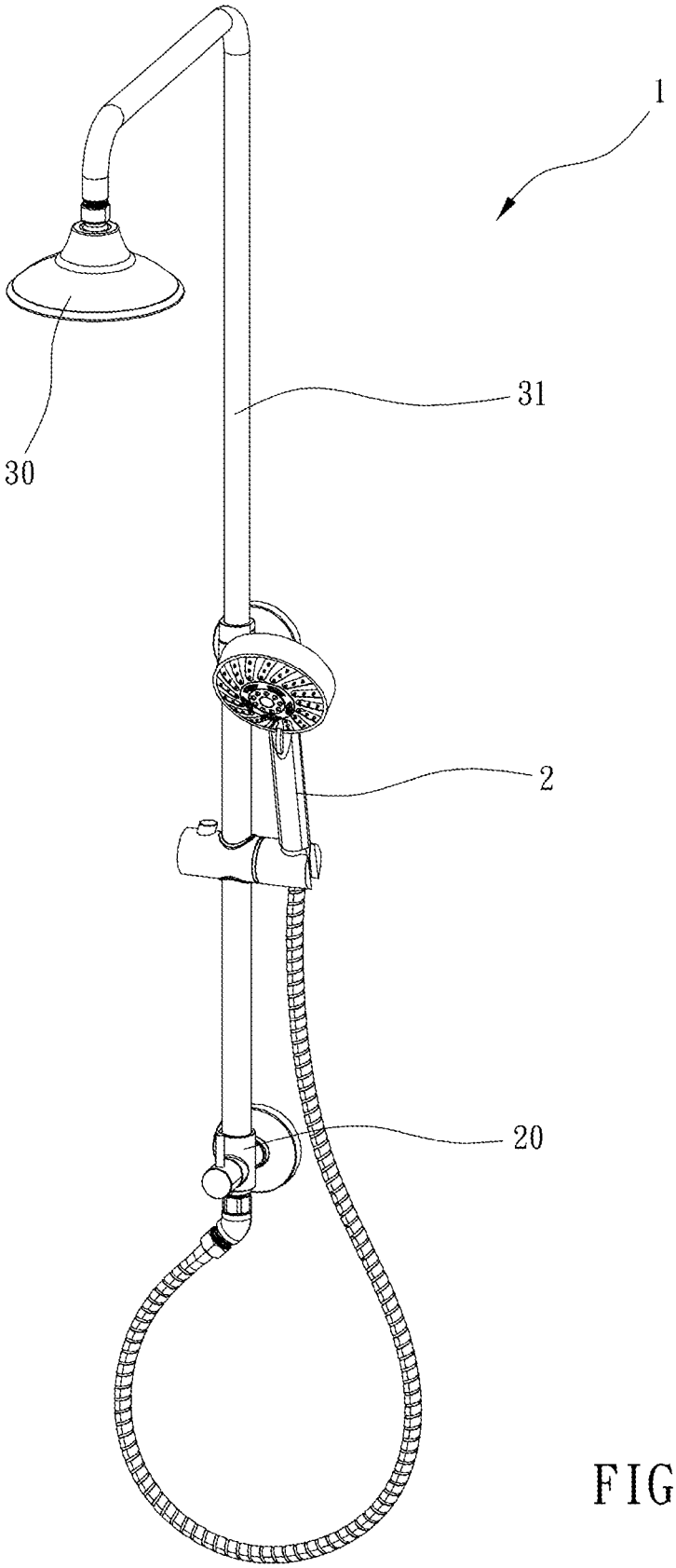
FIG. 1 is a stereogram of a preferable embodiment of the present invention.
Figure 2:
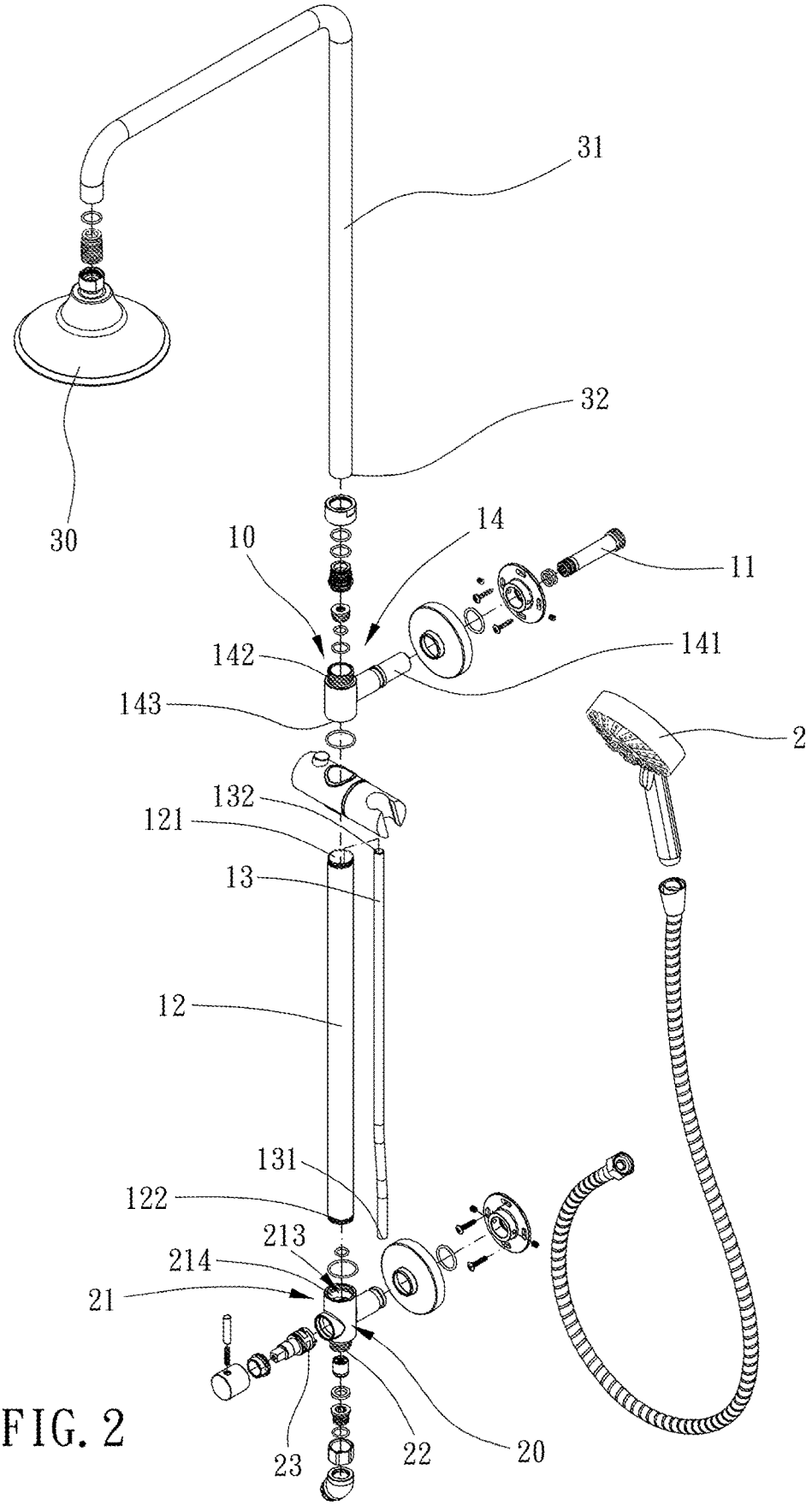
FIG. 2 is a breakdown drawing of a preferable embodiment of the present invention.
Figure 3:
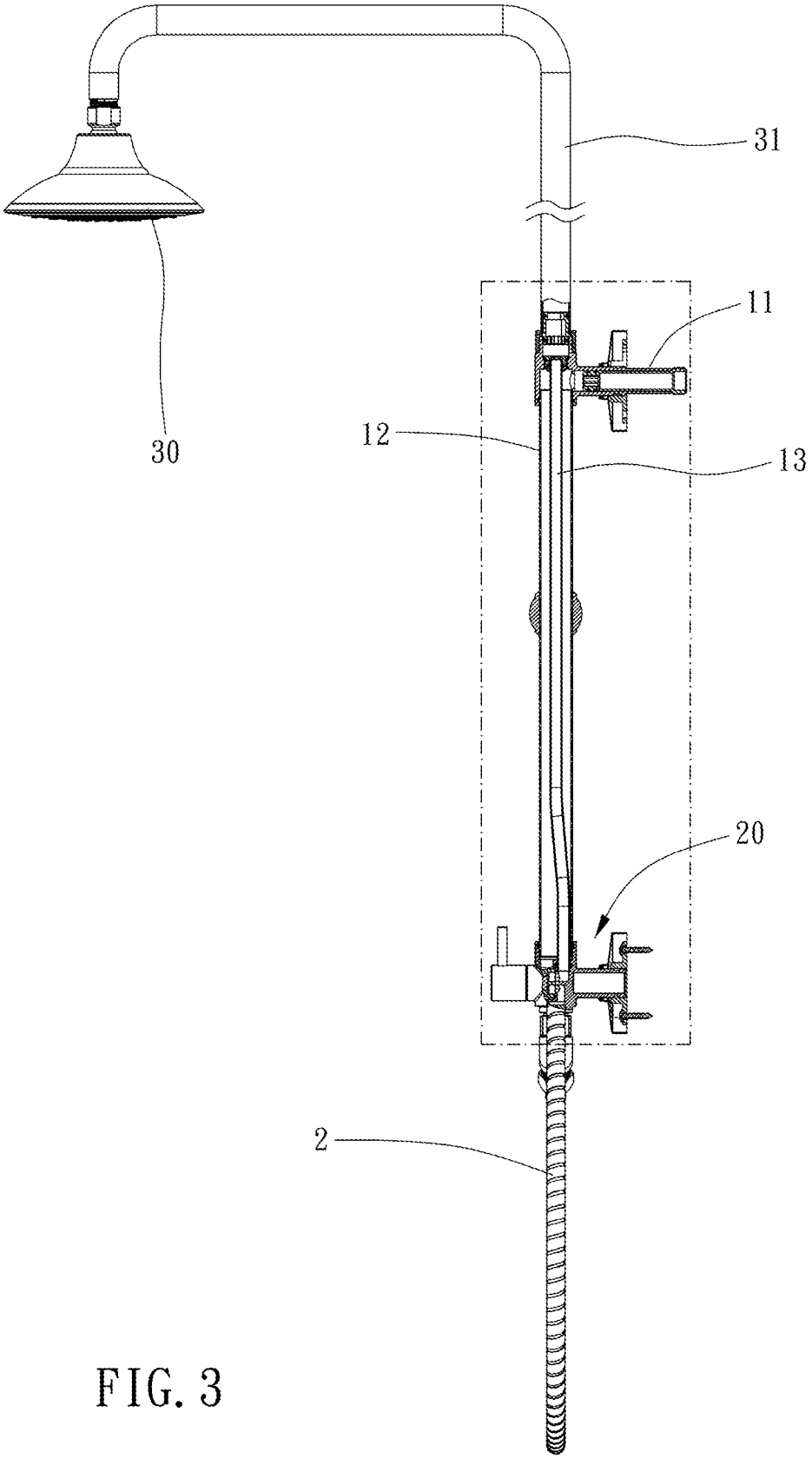
FIG. 3 is a partial cross-sectional view of a preferable embodiment of the present invention.
Figure 4:
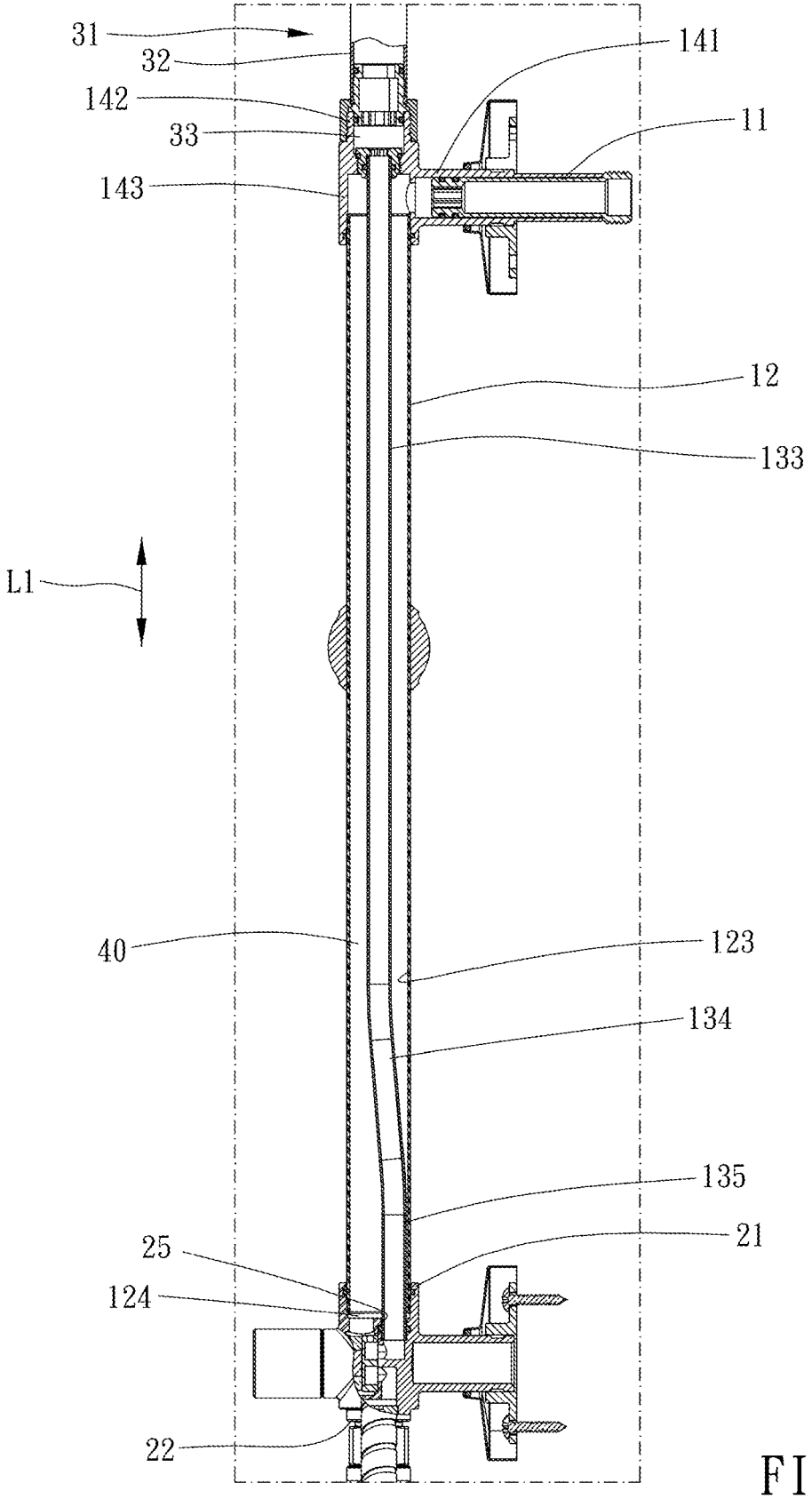
FIG. 4 is a partial enlargement of FIG. 3.
Figure 5:
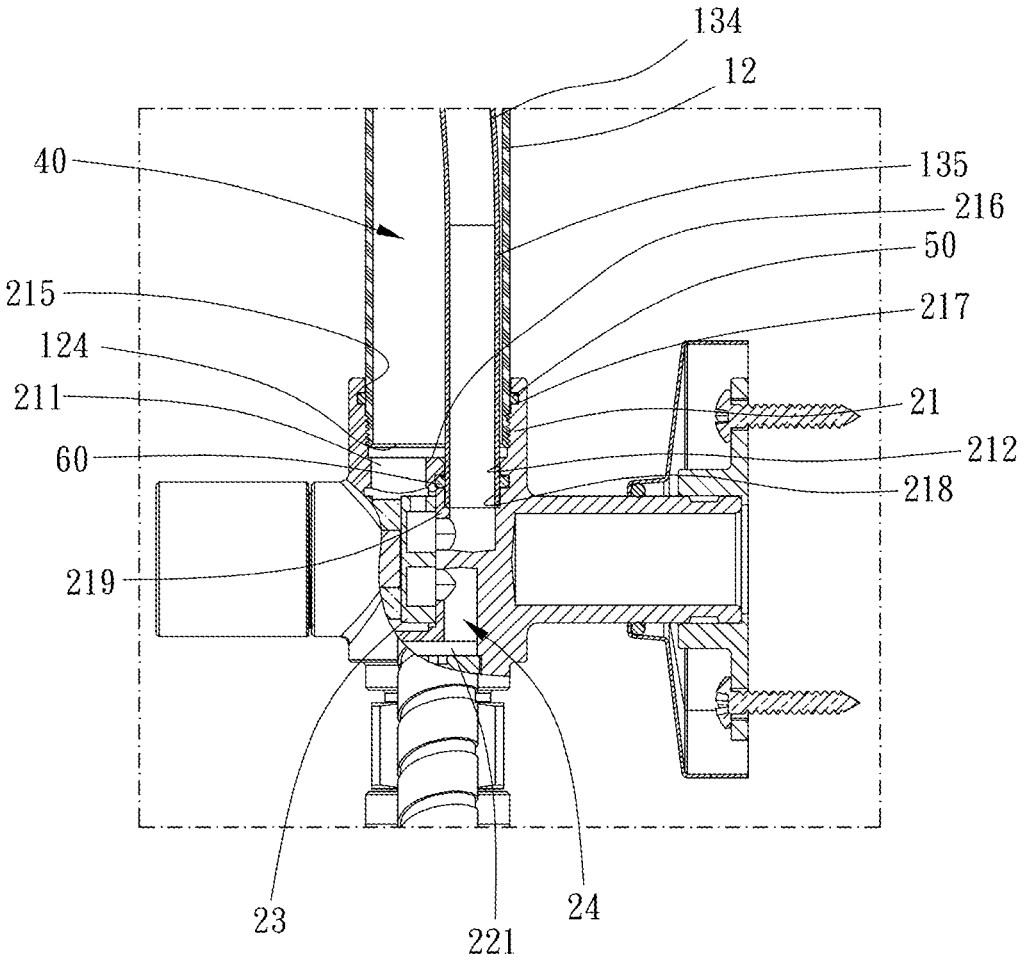
FIG. 5 is a partial enlargement of FIG. 4.
Figure 6:
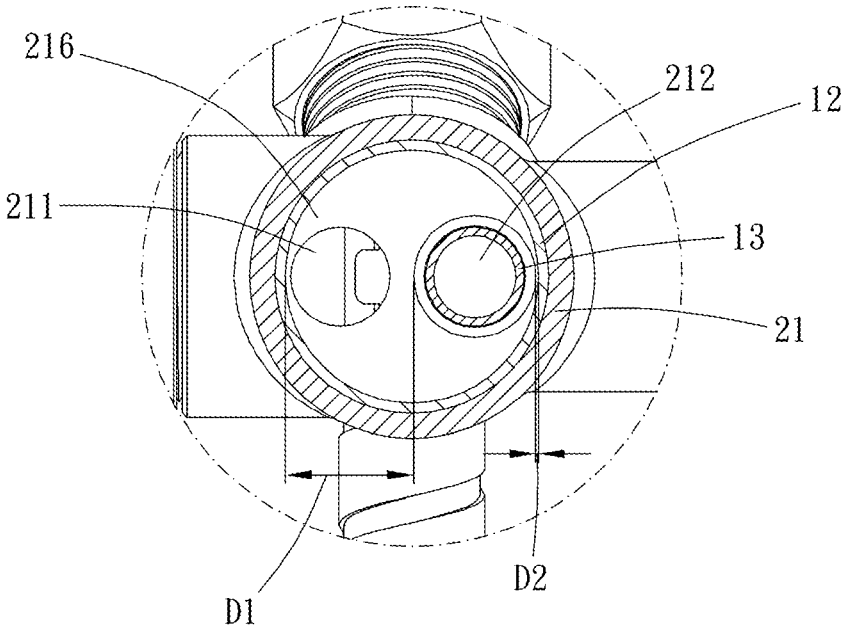
FIG. 6 is a partial cross-sectional view of another preferable embodiment of the present invention.
Figure 7:
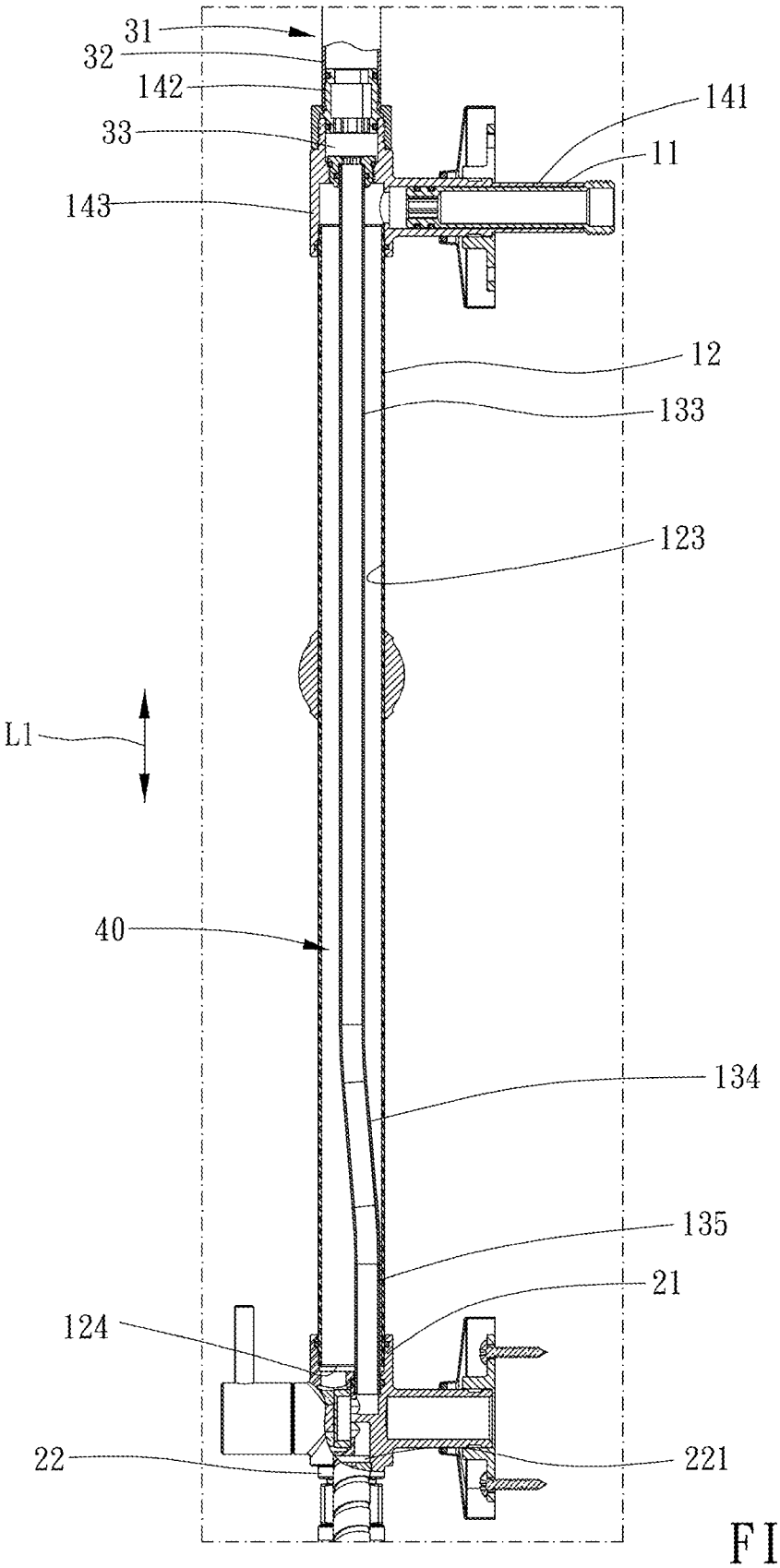
FIG. 7 is a drawing showing an inner pipe in communication with an outlet according to a preferable embodiment of the present invention.

Please refer to FIGS. 1 to 7 for a preferable embodiment of the present invention. A shower device 1 of the present invention includes a pipe assembly 10, a water separator 20 and a shower flower 30.

The pipe assembly 10 includes an inlet pipe 11, an outer pipe 12 and an inner pipe 13, the inner pipe 13 is disposed in the outer pipe 12, and the inlet pipe 11 is configured to be in communication with a water supply source. The outer pipe 12 includes a first end portion 121 and a second end portion 122, and the inlet pipe 11 is connected and in communication with the first end portion 121 of the outer pipe 12. The water separator 20 is configured to be fixedly mounted to a base (such a wall), the water separator 20 includes a first port 21, a second port 22 and a control valve 23, the first port 21 includes a first assembling portion 213 and a second assembling portion 25, the second end portion 122 of the outer pipe 12 is connected with the first assembling portion 213, an inlet end portion 131 of the inner pipe 13 is connected with the second assembling portion 25, and the second port 22 includes an outlet 221. The shower flower 30 is connected with the outer pipe 12 and in communication with the inner pipe 13. In this embodiment, the outlet 221 is configured to be connected with a handle shower 2, and the handle shower 2 and the outlet 221 are in communication with each other. The control valve 23 is configured to conduct communication of the outer pipe 12 and the inner pipe 13 or to conduct communication of the outer pipe 12 and the outlet 221 so that water can flow out from the shower flower 30 or from the handle shower 2. The outer pipe 12, the inlet pipe 11 and a chamber 24 of the water separator 20 are in communication with each other to form an inlet pipeline. The outer pipe 12, the inner pipe 13, the chamber 24 of the water separator 20 and a guiding pipe 31 of the shower flower 30 are in communication with each other to form a guiding pipeline. The outer pipe 12, the outlet 221 and the chamber 24 of the water separator 20 are in communication with each other to form an outlet pipeline. Whereby, the inlet pipeline is conducted to the guiding pipeline, and the inlet pipe 11 is located higher than the water separator 20.

The inner pipe 13 further includes an outlet end portion 132 in communication with the inlet end portion 131, the outlet end portion 132 is in communication with the shower flower 30, and the outer pipe 12 extends in an axial direction L1. Specifically, the inner pipe 13 has a diameter smaller than a diameter of the outer pipe 12, and the inner pipe 13 includes a first straight section 133, a connection section 134 and a second straight section 135. The connection section 134 is connected between the first straight section 133 and the second straight section 135, the first straight section 133 includes the outlet end portion 132, the second straight section 135 includes the inlet end portion 131, the first straight section 133 and the second straight section 135 are axially offset, the second straight section 135 and the outer pipe 12 are non-coaxially arranged, and the second straight section 135 is nearer an inner circumferential wall 123 of the outer pipe 12 than the first straight section 133. Preferably, the first port 21 includes a first hole 211 and a second hole 212, the second assembling portion 25 includes the second hole 212, the first hole 211 and the second hole 212 are axially offset relative to and the outer pipe 12 respectively, the first hole 211 corresponds to and is in communication with an opening 124 of the outer pipe 12, and the inlet end portion 131 of the inner pipe 13 is connected and in communication with the second hole 212; The control valve 23 is configured to conduct communication of the first hole 211 and the second hole 212 or to conduct communication of the second hole 212 and the outlet 221. The opening 124 has a caliber larger than a caliber of the first hole 211. A channel 40 is defined between the outer pipe 12 and the inner pipe 13 and is in communication with the opening 124, and the first hole 211 and the channel 40 are in communication with each other. There are a largest interval D1 and a smallest interval D2 between the second straight section 135 and the inner circumferential wall 123 of the outer pipe 12, and the first hole 211 spatially corresponds to the largest interval D1, which the first hole 211 can be provided with a large size. The first straight section 133 and the outer pipe 12 are preferably co-axially arranged. The first straight section 133 has an extent larger than an extent of the second straight section 135. With a simple structure, the water can concentrated by the channel 40 and come into the chamber 24 of the water separator 20, and the flow path from the channel 40 to the inner pipe 13 or to the outlet 221 is simplified and shortened.

The shower device 1 further includes a first sealing ring 50, the first assembling portion 213 includes an insertion hole 214, an annular wall 215 and a bottom wall 216, the bottom wall 216 is laterally connected with the annular wall 215, the annular wall 215 and the bottom wall 216 define the insertion hole 214, and the outer pipe 12 is inserted within the insertion hole 214. In this embodiment, the outer pipe 12 is stably screwed with the insertion hole 214, the first hole 211 and the second hole 212 are respectively disposed through the bottom wall 216 and in communication with and the insertion hole 214, and the first sealing ring 50 is annularly disposed between the annular wall 215 and the outer pipe 12. The annular wall 215 includes an annular groove 217, and the first sealing ring 50 is engaged within the annular groove 217, which prevents leakage of water from the outer pipe 12.

The shower device 1 further includes a second sealing ring 60, the inlet end portion 131 of the inner pipe 13 is inserted within the second hole 212, and the second sealing ring 60 is disposed between the second hole 212 and the inner pipe 13. A hole wall 218 of the second hole 212 includes a flange 219 radially projects inwardly, and the inner pipe 13 is abutted against the flange 219 so that the inner pipe 13 can be stably supported and well-sealingly connected.

In this embodiment, the pipe assembly 10 further includes a tee 14, and the tee 14 includes a first tubular portion 141, a second tubular portion 142 and a third tubular portion 143. The inlet pipe 11 is inserted within the first tubular portion 141, the guiding pipe 31 of the shower flower 30 is connected and in communication with the second tubular portion 142, the first end portion 121 of the outer pipe 12 is connected with the third tubular portion 143, and the inner pipe 13 is inserted within the third tubular portion 143. The tee 14 is preferably fixed to the base by a fixation plate or fasteners, and the inlet pipe 11 is disposed through the fixation plate.

The shower flower 30 includes an assembling end portion 32, the assembling end portion 32 is connected with the second tubular portion 142, and the assembling end portion 32 and the outlet end portion 132 of the inner pipe 13 are arranged in interval and define a gap 33 therebetween. Preferably, the gap 33 has an inner diameter larger than respective inner diameters of the inner pipe 13 and the guiding pipe 31, and the assembling end portion 32 is disposed at an end of the guiding pipe 31.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A shower device including:

a pipe assembly including an inlet pipe, an outer pipe and an inner pipe, the inner pipe being disposed in the outer pipe, the inlet pipe being configured to be in communication with a water supply source, the outer pipe including a first end portion and a second end portion, the inlet pipe being connected and in communication with the first end portion of the outer pipe;

a water separator including a first port, a second port and a control valve, the first port including a first assembling portion and a second assembling portion, the second end portion of the outer pipe being connected with the first assembling portion, an inlet end portion of the inner pipe being connected with the second assembling portion, the second port including an outlet; and a shower flower being connected with the outer pipe and in communication with the inner pipe;

wherein the control valve is configured to conduct communication of the outer pipe and the inner pipe or to conduct communication of the outer pipe and the outlet;

wherein the inner pipe further includes an outlet end portion in communication with the inlet end portion, the outlet end portion is in communication with the shower flower, and the outer pipe extends in an axial direction;

wherein the inner pipe has a diameter smaller than a diameter of the outer pipe, the inner pipe includes a first straight section, a connection section and a second straight section, the connection section is connected between the first straight section and the second straight section, the first straight section includes the outlet end portion, the second straight section includes the inlet end portion, the first straight section and the second straight section are axially offset, the second straight section and the outer pipe are non-coaxially arranged, and the second straight section is nearer an inner circumferential wall of the outer pipe than the first straight section;

wherein the first port includes a first hole and a second hole, the second assembling portion includes the second hole, the first hole and the second hole are axially offset relative to the outer pipe respectively, the first hole corresponds to and is in communication with an opening of the outer pipe, the inlet end portion of the inner pipe is connected and in communication with the second hole; the control valve is configured to conduct communication of the first hole and the second hole or to conduct communication of the second hole and the outlet;

wherein the shower device further includes a first sealing ring, the first assembling portion includes an insertion hole, an annular wall and a bottom wall, the bottom wall is laterally connected with the annular wall, the annular wall and the bottom wall define the insertion hole, the outer pipe is inserted within the insertion hole, the first hole and the second hole are respectively disposed through the bottom wall and in communication with the insertion hole, and the first sealing ring is annularly disposed between the annular wall and the outer pipe.

2. The shower device of claim 1, wherein the opening has a caliber larger than a caliber of the first hole.

3. The shower device of claim 2, wherein a channel is defined between the outer pipe and the inner pipe and is in communication with the opening, the first hole and the channel are in communication with each other, there are a largest interval and a smallest interval between the second straight section and the inner circumferential wall of the outer pipe, and the first hole spatially corresponds to the largest interval.

4. The shower device of claim 3, wherein the first straight section and the outer pipe are co-axially arranged; the first straight section has an extent larger than an extent of the second straight section; the annular wall includes an annular groove, the first sealing ring is engaged within the annular groove; the shower device further includes a second sealing ring, the inlet end portion of the inner pipe is inserted within the second hole, the second sealing ring is disposed between the second hole and the inner pipe, a hole wall of the second hole includes a flange radially projects inwardly, and the inner pipe is abutted against the flange; the pipe assembly further includes a tee, the tee includes a first tubular portion, a second tubular portion and a third tubular portion, the inlet pipe is inserted within the first tubular portion, a guiding pipe of the shower flower is connected and in communication with the second tubular portion, the first end portion of the outer pipe is connected with the third tubular portion, and the inner pipe is inserted within the third tubular portion; the shower flower includes an assembling end portion, the assembling end portion is connected with the second tubular portion, and the assembling end portion and the outlet end portion of the inner pipe are arranged in interval and define a gap therebetween.

5. The shower device of claim 1, wherein the pipe assembly further includes a tee, the tee includes a first tubular portion, a second tubular portion and a third tubular portion, the inlet pipe is inserted within the first tubular portion, a guiding pipe of the shower flower is connected and in communication with the second tubular portion, the first end portion of the outer pipe is connected with the third tubular portion, and the inner pipe is inserted within the third tubular portion.

6. A shower device including:

a pipe assembly including an inlet pipe, an outer pipe and an inner pipe, the inner pipe being disposed in the outer pipe, the inlet pipe being configured to be in communication with a water supply source, the outer pipe including a first end portion and a second end portion, the inlet pipe being connected and in communication with the first end portion of the outer pipe;

a water separator including a first port, a second port and a control valve, the first port including a first assembling portion and a second assembling portion, the second end portion of the outer pipe being connected with the first assembling portion, an inlet end portion of the inner pipe being connected with the second assembling portion, the second port including an outlet and a shower flower being connected with the outer pipe and in communication with the inner pipe;

wherein the control valve is configured to conduct communication of the outer pipe and the inner pipe or to conduct communication of the outer pipe and the outlet;

wherein the inner pipe further includes an outlet end portion in communication with the inlet end portion, the outlet end portion is in communication with the shower flower, and the outer pipe extends in an axial direction;

wherein the inner pipe has a diameter smaller than a diameter of the outer pipe, the inner pipe includes a first straight section, a connection section and a second straight section, the connection section is connected between the first straight section and the second straight section, the first straight section includes the outlet end portion, the second straight section includes the inlet end portion, the first straight section and the second straight section are axially offset, the second straight section and the outer pipe are non-coaxially arranged, and the second straight section is nearer an inner circumferential wall of the outer pipe than the first straight section;

wherein the first port includes a first hole and a second hole, the second assembling portion includes the second hole, the first hole and the second hole are axially offset relative to the outer pipe respectively, the first hole corresponds to and is in communication with an opening of the outer pipe, the inlet end portion of the inner pipe is connected and in communication with the second hole; the control valve is configured to conduct communication of the first hole and the second hole or to conduct communication of the second hole and the outlet;

wherein the shower device further includes a second sealing ring, the inlet end portion of the inner pipe is inserted within the second hole, the second sealing ring is disposed between the second hole and the inner pipe, a hole wall of the second hole includes a flange radially projects inwardly, and the inner pipe is abutted against the flange.

* * * * *